US008669873B2

(12) United States Patent
Joseph

(10) Patent No.: US 8,669,873 B2
(45) Date of Patent: Mar. 11, 2014

(54) INVENTORY AND ANTI-THEFT ALARM SYSTEM

(76) Inventor: Joseph Joseph, Jamaica, NY (US)

( * ) Notice: Subject to any disclaimer, the term of this patent is extended or adjusted under 35 U.S.C. 154(b) by 321 days.

(21) Appl. No.: 13/200,778

(22) Filed: Sep. 30, 2011

(65) Prior Publication Data

US 2013/0082841 A1 Apr. 4, 2013

(51) Int. Cl.
*G08B 13/14* (2006.01)

(52) U.S. Cl.
USPC ..... 340/572.1

(58) Field of Classification Search
USPC ..... 340/572.1–572.9, 10.1; 235/487
See application file for complete search history.

(56) References Cited

U.S. PATENT DOCUMENTS

| | | | | |
|---|---|---|---|---|
| 6,092,932 | A * | 7/2000 | Pekala et al. | 383/75 |
| 2007/0252707 | A1* | 11/2007 | Seidel | 340/572.9 |
| 2008/0084313 | A1* | 4/2008 | Seidel | 340/572.9 |
| 2010/0164710 | A1* | 7/2010 | Chung et al. | 340/539.1 |
| 2013/0075481 | A1* | 3/2013 | Raymond et al. | 235/492 |

* cited by examiner

*Primary Examiner* — Phung Nguyen
(74) *Attorney, Agent, or Firm* — Stephen E. Feldman; Feldman Law Group, P.C.

(57) ABSTRACT

An inventory and antitheft alarm tag utilizes RFID technology. The system provides either real time or time of scan inventory and theft control while monitoring the time and date of each lock/unlock event and the sequence of these events.

15 Claims, 7 Drawing Sheets

INVENTORY AND ANTI-THEFT ALARM SYSTEM

BACKGROUND

The present invention relates to an inventory and anti-theft alarm system. In particular the present invention relates to an inventory and/or anti-theft alarm system that utilizes an RFID tag for providing an inventory and/or anti-theft control in either real time or at the time of a scan. The alarm tag includes an encoded unique RFID inlay and a RF transmitter and circuit that is applied to the merchandise to be inventoried. The unique RFID inlay is encoded with a unique "serial number" that is indigenous to a particular tag. As such, the particular encoded number is unique to any one particular tag and in this way the present invention can track each particular tag to its location in a premise.

A major problem in any inventory stocking environment is theft. The present invention provides a system and a method to avoid such theft using an inventory and anti-theft alarm system employing an RFID tag for maintaining an ongoing log or record of the number of times an RFID tag and transmitter has been locked e.g. applied to, or unlocked e.g. removed from an item of merchandise, and keeps track of the unique numbered sequence for that event. For example, if a tag is reused after the sale of merchandise, it would have an "add the tag", "sell the item", "remove the tag" and "apply to a new tag" status.

The number of logical sequences not being correct, indicates that something is amiss and that the tag may have been removed by a thief who stole the item after the last time that particular tag was applied. Otherwise the tag should be flagged for investigation by the store manager. Therefore it would be desirable to provide a method and system that can overcome these problems, and provide an alert so that if the tag was not opened or closed the appropriate number of times a possible theft or tampering of the tag took place.

RELATED ART

Current RFID technology does not provide 100% inventory control. In current RFID technology, if an RFID tag is attached to, and subsequently removed from an item of merchandise, but the RFID TAG is not removed from the premises or the original location of where the item of merchandise was located, an inventory scan, typically done with an RFID handheld device or an antenna array, would fail to detect the item of merchandise as being missing from the premises as it would still locate the tag. This would lead to the false conclusion that the item of merchandise associated with the tag is still on the premises since the tag is still detected as being present on the premises.

U.S. Pat. No. 5,539,394 relates to a method of communicating between a central location and a plurality of identification tags or labels. However this is accomplished without separately passing each tag or labeled product through a reading station via radio communication by using a combination of broadcast and time division multiplex architectures.

U.S. Pat. No. 5,963,144 discloses a cloaking circuit for assisting in reading operations of RFID transponders. The antenna of the RFID tag or label is disconnected from the balance of the RFID chip by a switch activated in response to a logic command generated by the RFID chip.

SUMMARY

The present invention provides for an inventory and/or anti-theft alarm system that can monitor the opening or closing of an alarm tag equipped with an RF chip and an RFID inlay to provide a unique rolling sequence event for tracking and analyzing the event relative to previous or subsequent unique event sequences. This is done to determine if the event is appropriate and in proper sequence. In particular, each alarm tag of the present invention includes an encoded unique RFID inlay that has a unique number assigned to each tag and has the ability to locate the tag in the premises such as but not limited to a store, warehouse or container. The alarm tag also includes an RF transmitter and circuit or a "counting/cut chip" that keeps track of the sequential event sequence number every time the locking pin is locked (circuit closed) or unlocked or the cable is cut (circuit is open) e.g. increases the count by one. The "counting/cut" chip and the RFID inlay share the same tag. There is a systematic association between the "counting/cut" chip and the unique encoded RFID inlay number so that they interact only with each other to permit the writing of data or the reading of data relative to the locking or unlocking or cut cable transactions at the tag. These are events which might happen between the chip and its associated RFID inlay. In the event of an inappropriately sequenced event, the unique sequence event will be referred to a manager for potential theft investigation. The present invention employs RFID technology to provide a logical real time status concerning the locking and unlocking of the tag associated with the item of merchandise the tag is attached to via the opening and/or closing of the on-board circuit. It will also identify whether the tagged item is or is not present on the premises and the identifying location of the merchandise. This is all done with the use of RFID technology.

DETAILED DESCRIPTION OF THE PREFERRED EMBODIMENT(S)

FIGS. 1A-C and 2 illustrate a RFID tag system for the present invention as it is applied to an item of merchandise. The present invention provides for a system that provides an inventory and/or anti-theft alarm tag or label utilizing RFID technology. As each item is presented as inventory in the system it can be tagged or labeled with RFID technology and placed in a master database. If the item is selected for purchase by a customer then it is scanned at point of sale and the RFID tag or label is deactivated and can be used again for another item of merchandise.

The master database 15 may also be interrogated by the system. The master database 15 (FIG. 2) contains pertinent information which is systematically matched to or related by information to the RFID tag 5. The master database 15 may contain, by way of non-limiting illustrative example, information such as SKU, color, style, size, cost, retail price, quantities, etc. of each item of merchandise. As noted previously each item of merchandise will have its own unique RFID tag 5. The RFID tag 5 information includes a unique serial number which can include, but is not limited to, product keys such as for a class or department code to identify the associated item the tag 5. The master database 15 can index through the unique RFID items and their corresponding SKUs and/or other relevant information providing a valuable tool for identifying and locating the item being sought. In addition this information permits the present invention to effectively track the sequence number for each lock/unlock/cut cable/commissioning/scan activity as described below in detail.

Figure 1A:
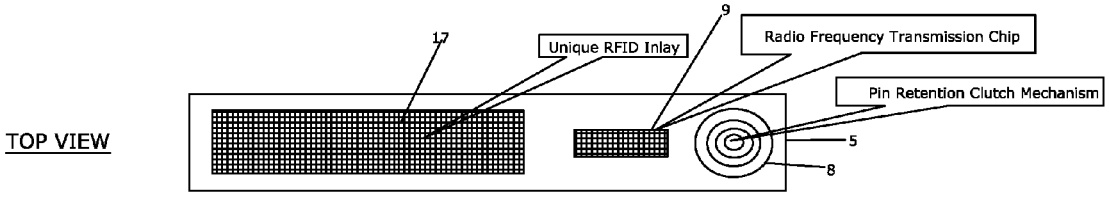
FIG. 1A is a top view or the RFID Tag of the present invention.
Figure 1B:
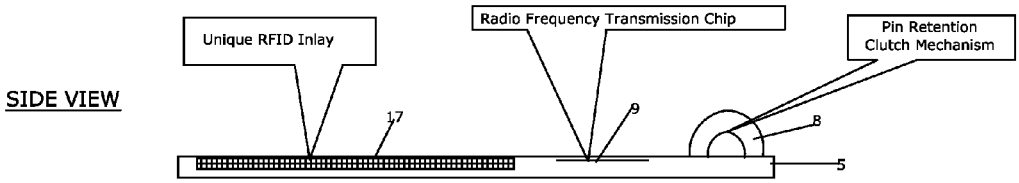
FIG. 1B is a side view of the RFID Tag of the present invention.
Figure 1C:
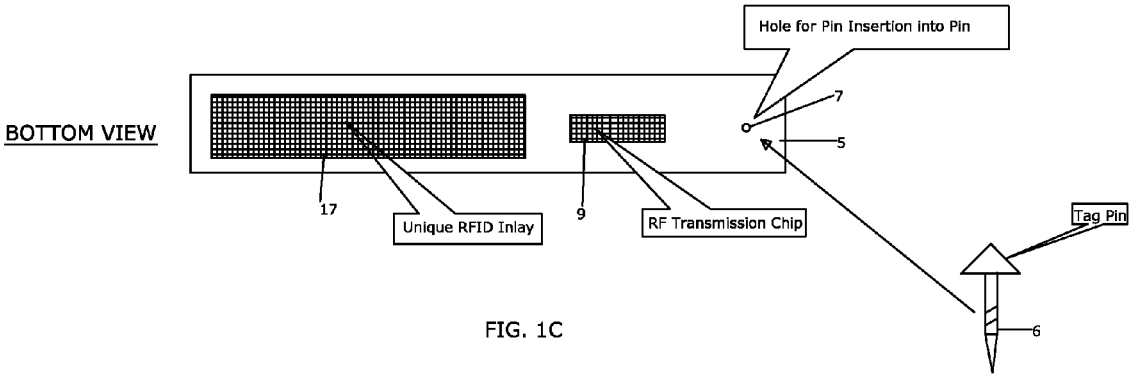
FIG. 1C is a bottom view of the RFID Tag of the present invention.

FIGS. 1A-C illustrate how the RFID tag 5 may be attached to an item of merchandise such as but not limited to a garment item or a pair of shoes. In a preferred embodiment of the present invention, as shown in FIG. 1A-C, an RFID tag 5 is equipped with a locking pin 6 and or a cable/clutch assembly 8 and an on-board RF transmitter 9 and circuit or "counting/cut" chip incorporated in the RFID inlay 17. This "counting/cut" chip keeps track of a sequential event sequence number that increases by "1" every time the locking pin 6 is locked or unlocked or in the event the cable is cut. Further, every time the event sequence number changes, caused by a locking or unlocking event or a cut cable, the on-board counting/cut chip would transmit the new sequence number to the RFID inlay 17 in the same tag 5 and/or to a receiver in the location.

The insertion of the pin 6 or cable into the clutch mechanism in effect closes the loop in the circuit. If the pin is removed, or the cable is cut, the circuit is broken and the breaking of the circuit triggers a unique sequence event to the counting/cut chip.

The software used by the invention is proprietary in design and as such we are providing an overview. The insertion of a pin 6 or lanyard into the clutch mechanism causes a transmission of a closed status for that particular RFID Tag 5 and its on-board circuitry 17. This information as well as date, time, operator, etc are stored in the memory of the RF chip on the tag as well as in the master database and as such the "counting/closing" begins. Upon the pin being released from the clutch and/or the cable being cut, the circuit is broken triggering an "open" transaction that is captured by the database and stored. The software tracks status of the tag and updates status, for example, if: the tag is open and the circuit is open, the tag is closed by operator onto the garment, the tag is closed and circuit is closed, the data of the tag is passed electronically to a database and/or when the tag closes a Status Reported to Master Database and a Unique Sequence Event Recorded.

The tag 5 has an RFID inlay 17 and a pin 6 that is inserted into an opening 7 and locked in place by a clutch mechanism 8 to affix the tag 5 to the item of merchandise as shown in FIGS. 1A-C. The pin 5 and clutch mechanism 8 can be unlocked and relocked at point of sale. When the pin 5 is inserted into the clutch 8 at the time of RFID commissioning it completes a circuit for notifying the on-board smart or counting/cut chip that the tag is locked and records the time and date of each subsequent lock/unlock event. It also records a sequence of these events. This information is provided to the master database 15 using the unique RFID encoded item number. The encoded item number which can be encoded in the inlay 17 that the item is locked and in inventory as well as the lock/unlock sequence number.

The process of "commissioning" is the process wherein the SKU, item number or UPC number of the item is "married" with the unique RFID number contained in the tag. This is accomplished by first obtaining a standard BAR code read of the item's SKU and then associating that number with the unique RFID number in the SQL master database. Alternatively, if the SKU number is already known, the software can marry that number with the unique RFID number. This can be done on a conveyor system or one-by-one using a standard BAR code scanner and an RFID reader/writer. The associated pairing of the BAR code SKU and RFID tag number can be accessed by using either number as the index key within the system.

Figure 3:
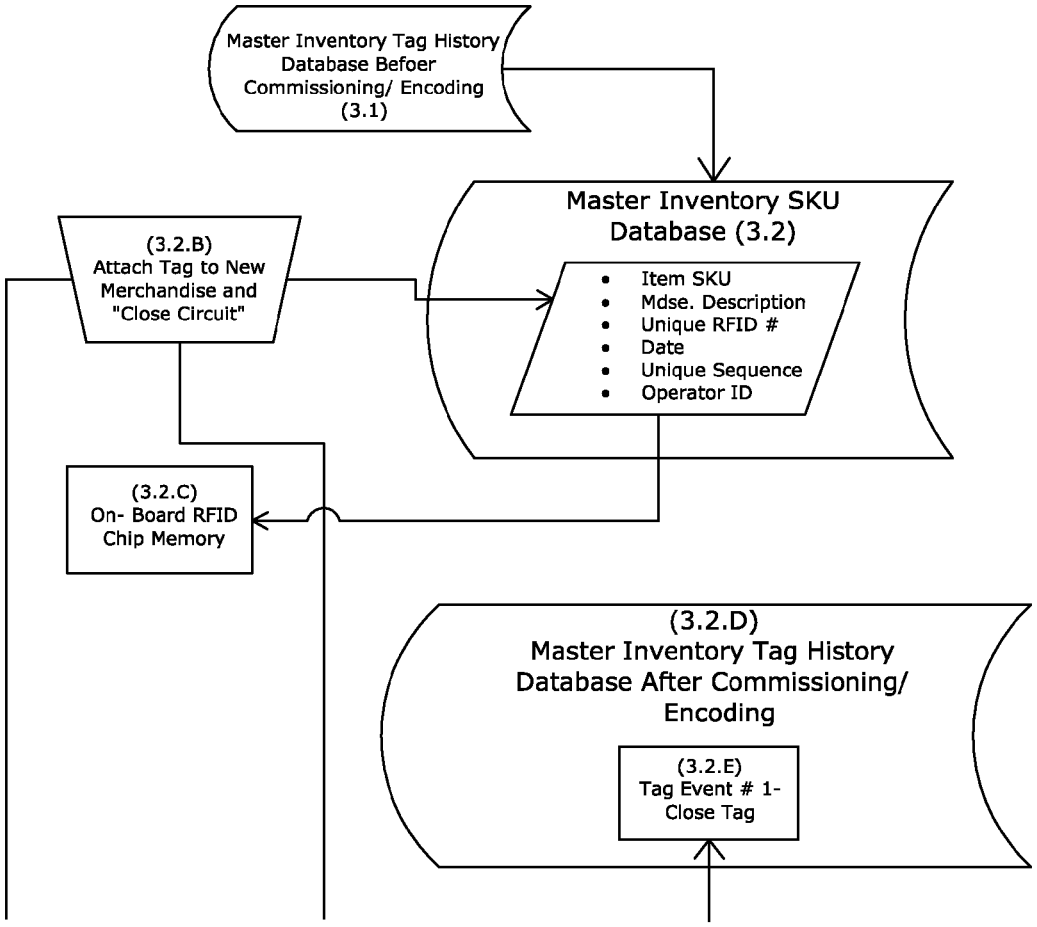
FIG. 3 is illustration of the present invention.

FIG. 3 shows a block diagram for the system. The Master Inventory Tag History Database before encoding of a new tag has no information on a tag until it is encoded (3.1.). The Master Inventory SKU Database contains information on every item that has been encoded (3.2) including, but not limited to: Item SKU, Merchandise Description, Unique RFID Tag Number, Date of Activity, Unique Sequence Number, and Operator ID (3.2.A). The RFID tag is attached to the new merchandise and "Close Circuit" status is sent to the Master Inventory Tag History Database (3.2.B). FIG. 3.2.D shows "Tag event #1—Closing of Tag" evidenced by 3.2.E and the association of that tag information is loaded to the Master Inventory SKU Database 3.2. FIG. 3.2.C shows the on-board memory chip of the RFID tag is now in-synch with the Master Inventory SKU Database. FIG. 3.2.D shows that after encoding, the Master Inventory Tag History Database now contains the unique event of the tag; the closing of the tag 3.2.E The counting/cut chip and the RFID inlay that share the same tag 5 are "partnered" with each other creating a systemic association linking the counting/cut chip ID with the unique RFID inlay's number for that particular tag 5. This is done so that they only interact with each other. In this way writing of data or reading of data relative to lock/unlock or cut cable transactions at the tag level can only happen between the corresponding, partnered chip and RFID inlay for that particular tag 5.

The counting/cut chip includes: an onboard memory; either an onboard power supply preferably either a battery or solar cell for powering a circuit. The counting/cut chip counts locking/unlocking or cut cable sequences; transmits information directly to the master database 15, a receiver or a handheld if the circuit is broken via the cable being cut or the pin being locked or unlocked. It can also transmit information directly to the memory of its paired RFID inlay if the circuit is broken via the cable being cut or the pin being locked or unlocked.

Figure 4:
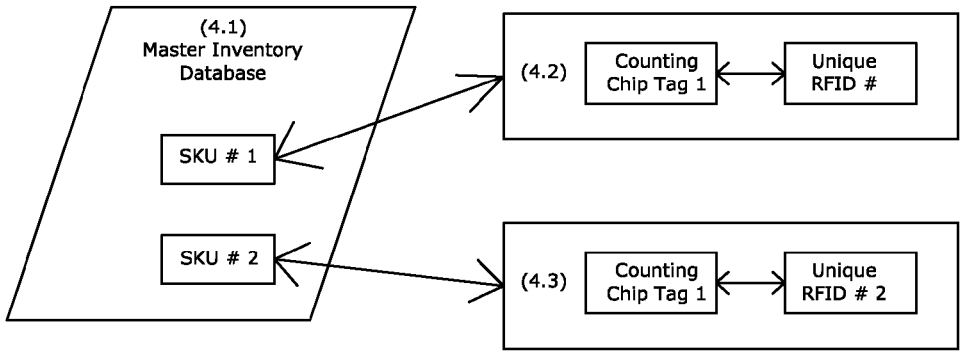
FIG. 4 is illustration of a master inventory database of the present invention.

As shown in FIG. 4, the Master Inventory Database contains information on all SKUs and UPCs and has a direct 1:1 unique relationship with each article of merchandise identified with a unique RFID tag illustrated in 4.2 and 4.3. Each RFID tag contains a unique RFID and unique counting chip that only communicates with each other and has a unique 1:1 relationship with a particular item of clothing. The association of that tag and the item of clothing is exclusive. This means that no other tag can be associated that article of clothing in the database (4.1).

The tag 5 can be one of the following: (a) the tag incorporates a separate counting/cut chip for writing to the enclosed RFID chip and/or (b) the tag is the RFID hybrid wherein the change in status of the tag (locked or unlocked) is written directly into the memory portion of the embedded RFID chip thus eliminating the need of an additional counting/cut chip. This encoding or commissioning is accomplished by taking user defined data and electronically writing it into the embedded memory of the RFID chip, using either an RFID antenna or other devices such as but not limited to an array of antennas, a handheld RFID scanner device, a RFID capable printer or any other RFID writeable device c. the tag is a radio frequency/RF chip 9 for transmitting data directly to a continuously scanning receiver for providing information to the inventory management system. This is done when the chip is energized by a receiver or changes in status.

Figure 2:
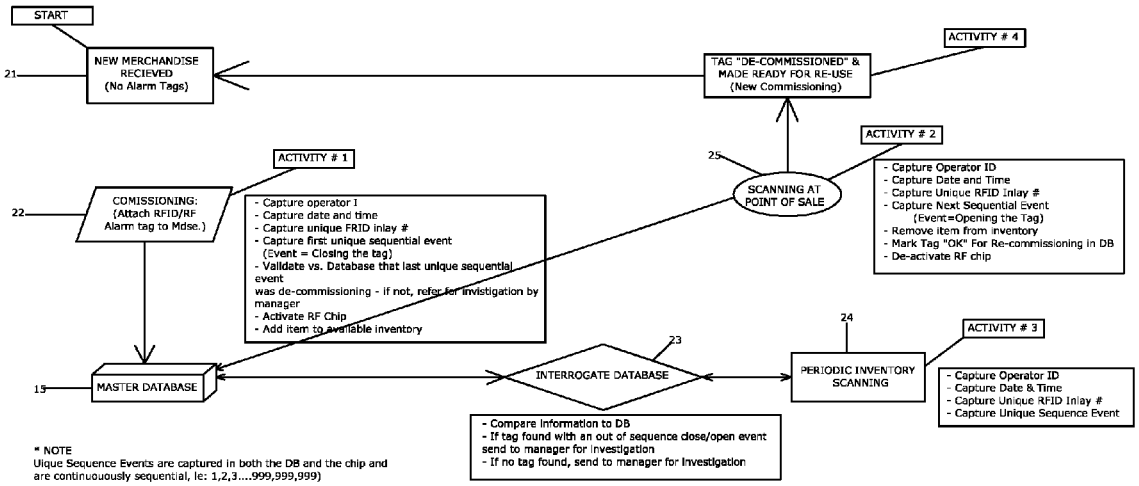
FIG. 2 is a flow chart illustrating the system of the present invention.

The RFID tag 5 communicates via an RF transmitter 9 to a master database 15 (See FIG. 2). The master date base 15 stores and can compare the information from the RFID tag 5 with the history of that particular RFID tag 5 to check the number of times the tag 5 has been locked and unlocked. It also compares the data on the tag 5 with the data in the master database 15.

Figure 5:
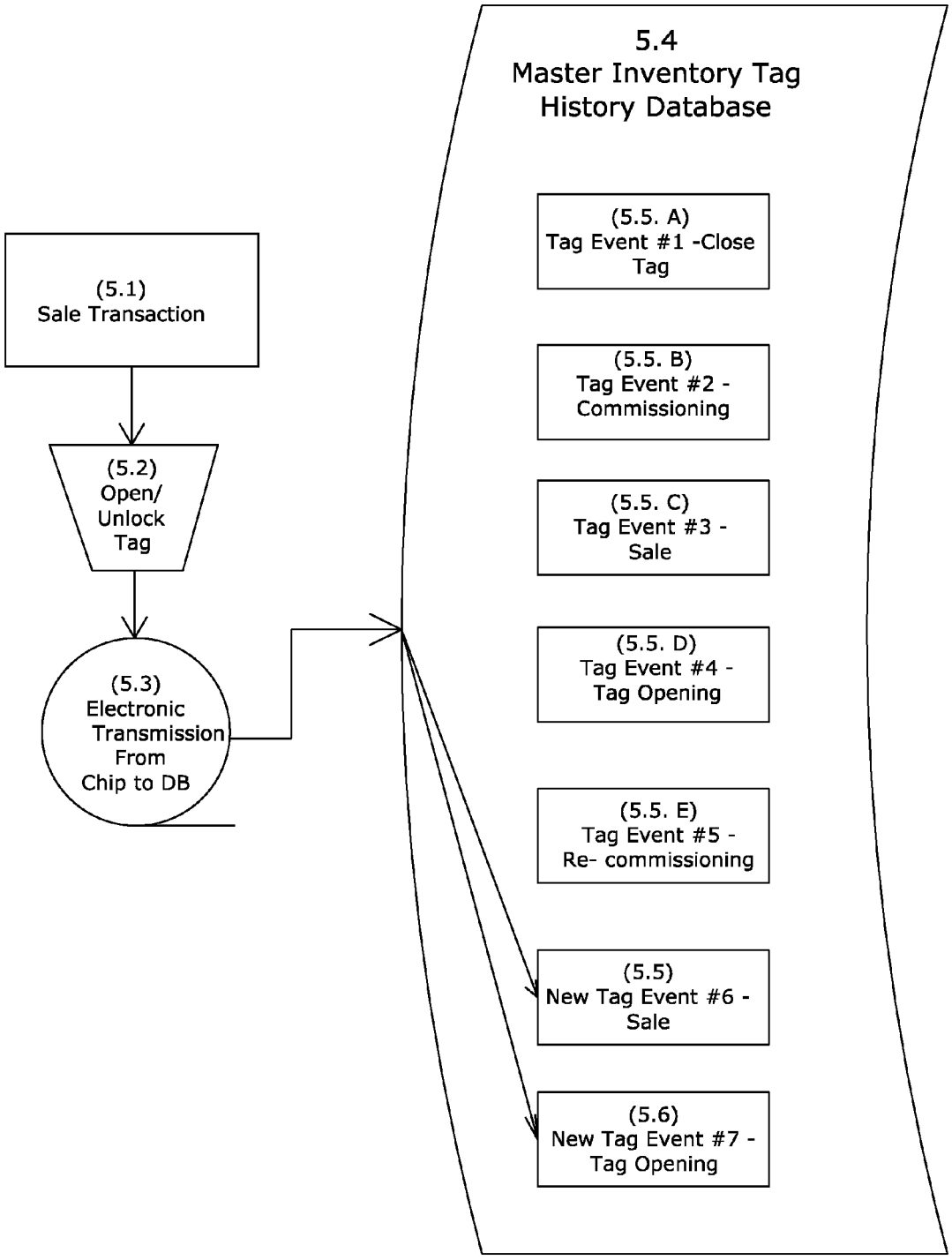
FIG. 5 is illustration of a master inventory tag history database of the present invention.
Figure 6:
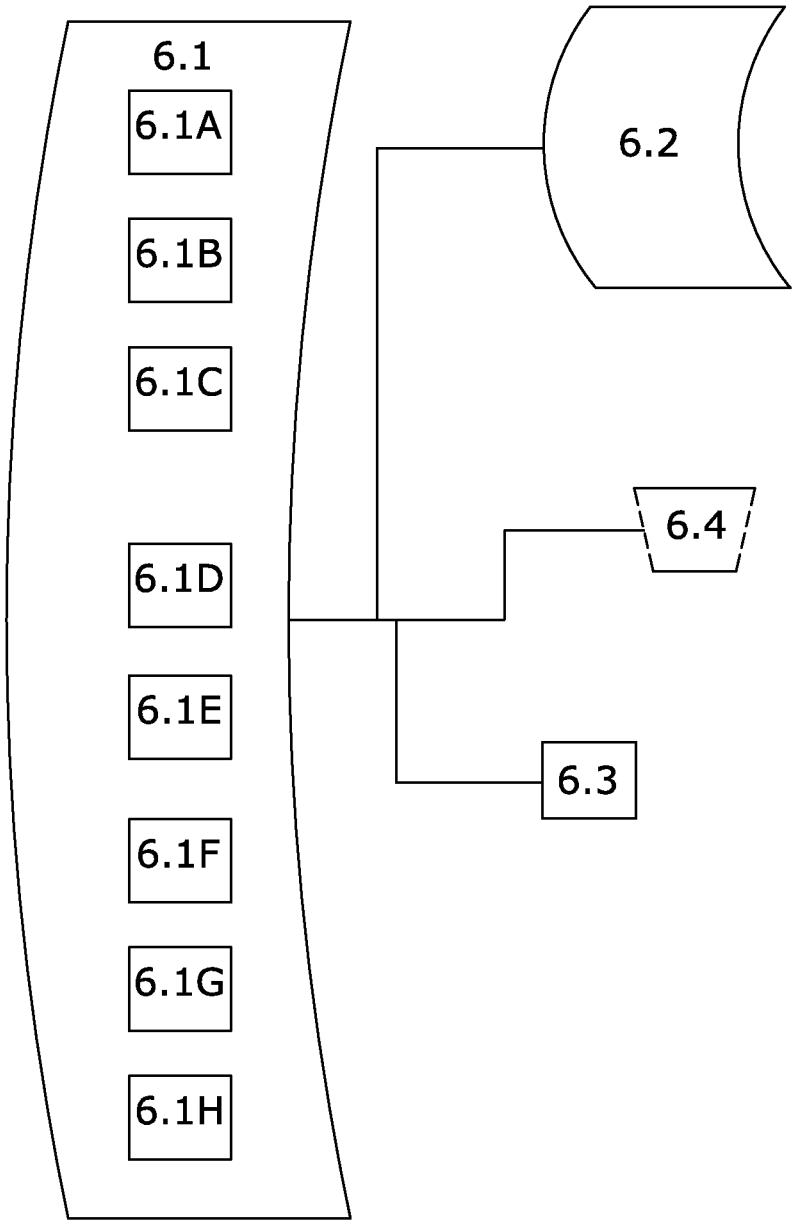
FIG. 6 is illustration of a master inventory tag history database of the present invention.
Figure 7:
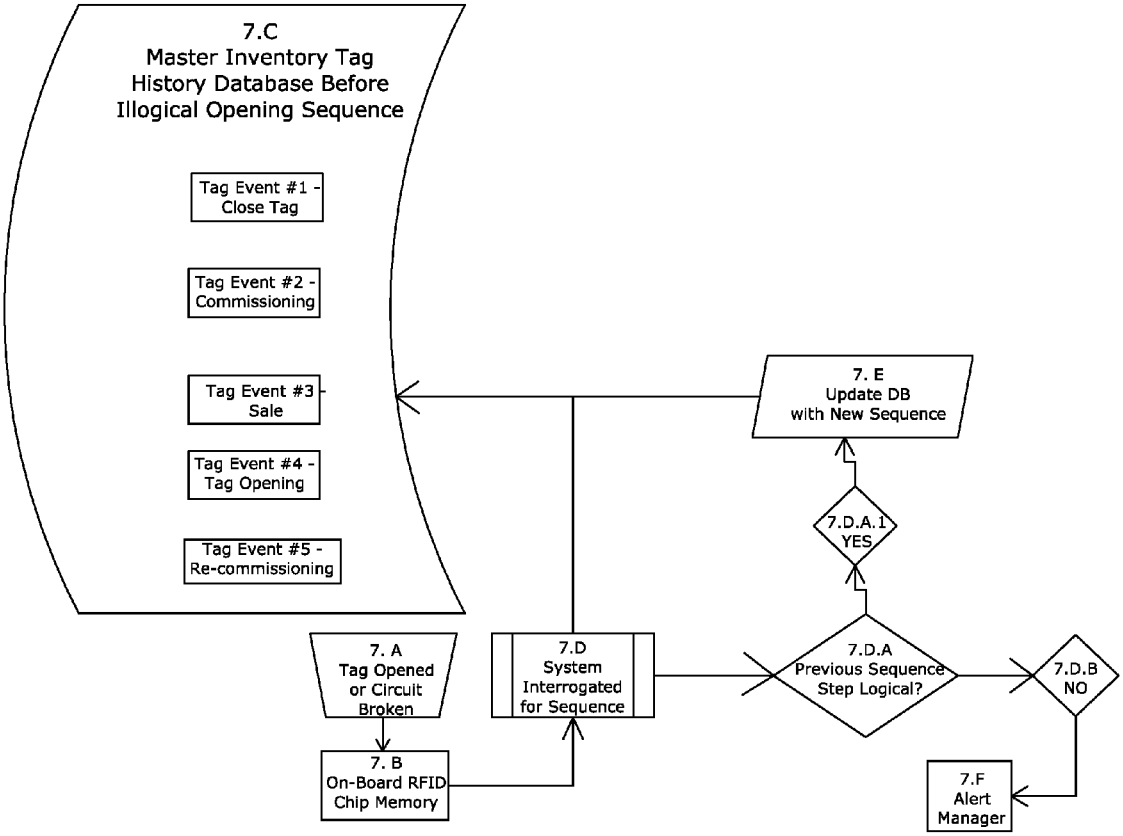
FIG. 7 is a flow chart illustrating an embodiment of the present invention.
Figure 8:
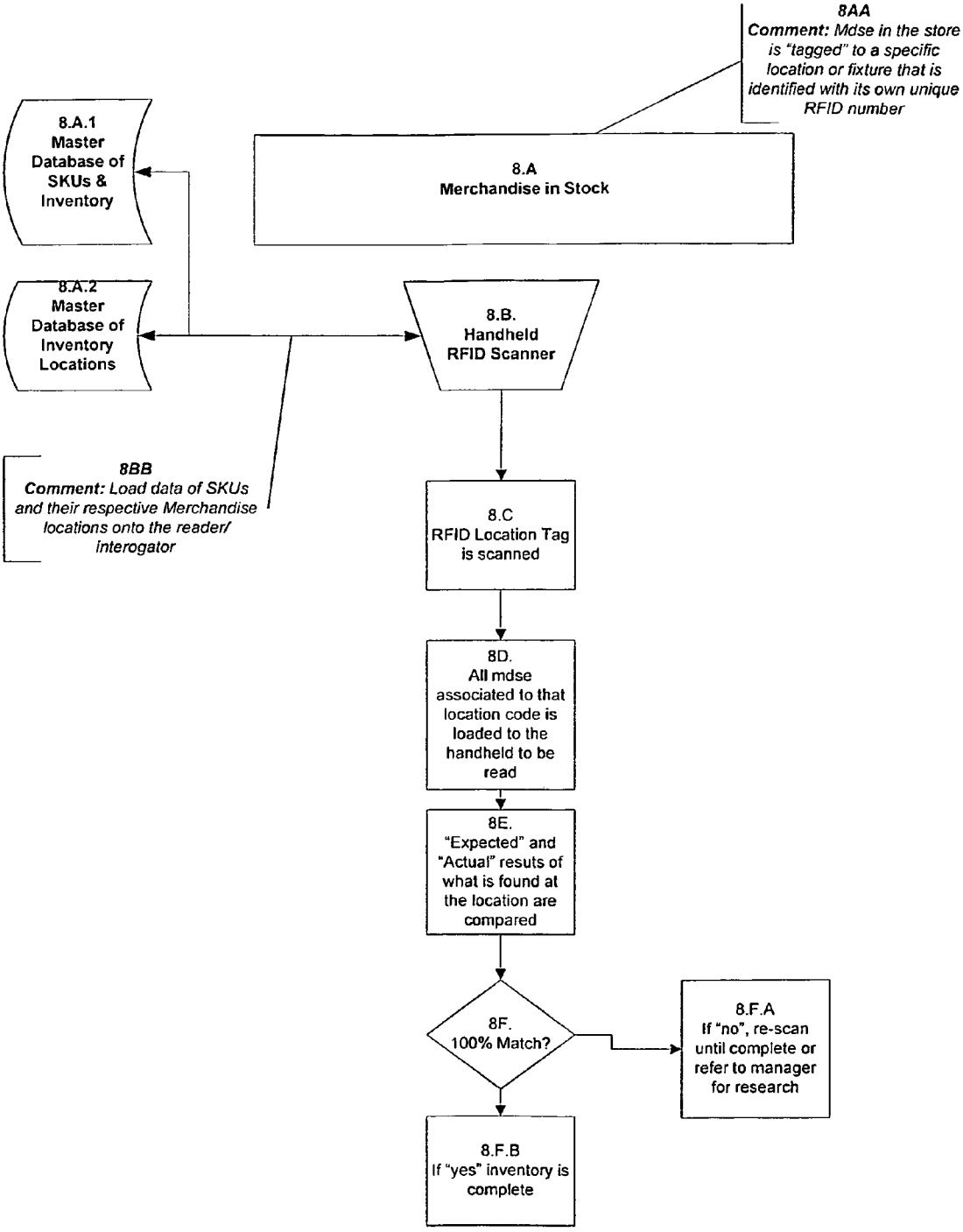
FIG. 8 is a flow chart illustrating an embodiment of the present invention.

As shown in FIG. 5, a sale transaction (5.1) allows the operator to unlock the RFID enabled tag (5.2) which creates an electronic transmission (5.3) to the Master Inventory Tag History Database (5.4) that updates the history for that tag with the event of the sale (5.5) and the opening of the tag (5.6) that are added to the existing sequences of past unique events for this tag: For examples, Tag Event #1—the first closing of the tag, Tag Event #2—the commissioning of the tag, Tag Event #3—the sale of the merchandise associated with the tag, Tag Event #4—the opening of a tag after the sale, Tag Event #5—the re-commissioning of the tag on a new piece of merchandise.

Each time an item of merchandise is sold the tag 5 is retired for that item and then the tag 5 is recommissioned for a new item of merchandise. In this way the tag 5 is opened to remove it from the sold item and closed for the new item which the tag is now affixed to so that the master data base 15 has a history of this removal and reuse (replacement) for merchandise items in association with that particular tag 5. This POS—point of sale—transaction, accomplished by RFID scan, systematically transmits this data and information to the master database 15. As seen in FIGS. 1A, 1B and 1C each RFID tag 5 has its own unique RFID inlay 7 and either a counting/cut chip or else the change in status of the tag 5 (e.g. locked or unlocked) is written directly into the memory of the embedded RFID chip and no additional counting/cut chip is required.

In the example, prior to a re-commissioning event, the Master Inventory Tag History Database (6.1) contains 7 events relative to a specific RFID tag: Tag Event #1: initial close of the tag, Tag Event #2: initial commissioning of the tag to a piece of merchandise, Tag Event #3: a sale transaction, Tag Event #4: The opening of the tag after the sale to remove from the merchandise, Tag Event #5: The re-commissioning of the tag to a new piece of merchandise, Tag Event #6: The subsequent sale of that merchandise and Tag Event #7: The opening of the tag after the sale.

This information is maintained in the Master Inventory Tag History Database (6.1) as well as the Master Inventory SKU database (6.2) as well as in the resident memory of the RFID tag (6.3). In the example, when the tag is attached to a new piece of merchandise, (6.4) the Master Inventory Tag History Database (6.1) and the Master Inventory SKU database (6.2) as well as in the resident memory of the RFID tag (6.3) are updated with a new unique event (6.1.H) that represents the tag closing and the re-commissioning of that tag onto a new piece of merchandise.

As seen in FIG. 2 the system of the present invention operates as follows: The system 20 receives a new item of merchandise (step 21). The RFID Tag 5 is attached or affixed to this merchandise (step 22). During this step the tag is commissioned (meaning that it is attached or affixed as described in FIGS. 1A-C and it is paired with the RFID number and SKU as well as an operator ID is captured by the system). The date and time is recorded for that merchandise item when the tag is affixed. The RF inlay is recorded by a systemic transaction which updates the master database 15 such as, by way of non-limiting example, a scan of the RFID chip by an RFID reader scan; the first sequential event is recorded—e.g. the locking of the tag 5 on this item of merchandise; a validation is performed by the master database 15: that the last unique event was a decommissioning of the tag (and if not it is referred to the manager for investigation). The chip is then activated and the item is added to the inventory in the master database 15 marking the item as commissioned. If a POS sales transaction associated with the unique RFID chip makes logical equable sense in terms of the locking/unlocking/cut data then no alert is sent to a store manager for investigation. One such logical sequential sequence would be a prior commissioning event, followed by a sales transaction event, followed by a recommissioning event, tied to a new item of merchandise. If there was a non logical sequence, then the item would be referred to the manager to investigate. The physical chip may or may not remain active at all times and available for scanning. The new item is added to the inventory in the master database 15 and is available in inventory.

This illustrates the sequence of events when a tag is opened, or the circuit is broken on a tag. When the system recognizes that a tag is open, (7.A), the on-board RFID chip (7.B) captures the event and reports that back to the Master Inventory Tag History Database (7.C) where the logical sequence of the event is checked versus prior events (7.D), If the sequence is logical (7.D.A) & (7.D.A.1) then the Master Inventory Tag History Database (7.C) is updated with the next sequence event (7.E). If the event is not logical (7.D.A) & (7.D.B), an alert is sent to the Manager (7.F) for further interrogation and review.

The data base 15 is systematically interrogated (step 23) and compares information from the tag 5 for the new merchandise item 21 with the master database 15. If the tag is determined to be an out of sequence event e.g. the number of opens and closes do not make logical sequential sense, then the item is flagged within the database and the item will require a further security investigation. This further investigation status for the item is displayed in the master database 15 and can be sent as a report, an email message or an automated cell phone call or text message to the manager to investigate the status of this item. Also if no tag is found a signal is sent to the manager to investigate by the same aforementioned means. The system is capable of periodic scanning as defined by the user using antenna arrays or hand held RFID scanners or any other suitable devices.

Software for inventory tracking is resident on the RFID handheld, computer, or other device used for inventory. Each display location has a unique RFID location. In the master database, items of inventory are associated 1:1 to that display location. A daily or ad-hoc download of those relationships are loaded into the handheld reader and or other RFID reading device. The scanning operation requires the operator to scan the RFID location tag and then "search" for each of the associated items of inventory. Software within the RFID reader-provides either an audio or visual display of items expected to be in that location or as the scan progresses and items are identified, they are dropped off the list viewable on the screen. When all items have been found, the operator is advised as such. Items not found are referred to a manager for investigation.

To take inventory of merchandise stock (8.A), subsets of the inventory Master Database of SKUs & Inventory stock (8.A.1) and the Master Database of Inventory Locations (8.A.2) are loaded onto a Handheld RFID Scanner, Computer with Antenna array, etc. (8.B). A location is selected from the Location database and the scanner reads the location code (8AA) for that location (8.C). The merchandise associated with that location code is loaded to the mobile device to be read (8.D) and reading begins (8.E) and compares "expected" results with "actual" results found. If there is a 100% match (8.F), inventory is complete (8.F.B). If there is not a 100% match in step (8.F), the differences between "actual" and "expected" results (8.F.A) are flagged or sent to the manager for research.

(Step 24). Such periodic scanning could be continuous and ongoing, include daily inventory, weekly inventory, monthly inventory, semi-annual inventory or an annual inventory period. This periodic scanning will capture all the user defined fields on the master database 15 and in the RFID chip as is required to complete all scanning that is required. At a point of sale transaction an RFID scan captures and updates the master database 15 with the user defined unique employee operator ID of the employee performing the transaction, the date and time of the transaction, the unique RFID inlay number of the item of merchandise associated with that transaction. The next sequential event e.g. is the unlock sequence number.

The captured transaction also removes the tag 5 from inventory in the master database 15 and identifies the tag 5 in the master database 15 as being available for recommissioning. This is accomplished by updating the individual record for that RFID tag 5 as being "sold" and available for recommissioning or reuse, and thus permitting the unique number of the RFID tag 5 to become associated with another item of merchandise in the master database 15 (step 21). Thus the present invention provides for an inventory and antitheft alarm tag utilizing RFID technology providing for either real time or time of scan inventory and theft control while monitoring the time and date of each locking/unlocking event and the sequence of these events.

While presently preferred embodiments have been described for purposes of the disclosure, numerous changes in the arrangement can be made by those skilled in the art. Such changes are encompassed within the spirit of the invention as defined by the appended claims.

What is claimed:

1. An inventory and anti-theft alarm tag system, comprising:

an RFID tag including an RFID transmitter;

a unique RFID inlay having a unique RFID encoded item number encoded therein; and a master database for communication between said RFID tag and said master database via said RF transmitter wherein said master database compares said information from said RF tag with that stored in said master database to determine if tag is authentic and has been open or closed the defined number of times indicated in the master database, and if so, a message is sent for investigation.

2. The system according to claim 1 wherein each RFID tag includes a smart chip.

3. The system according to claim 1 wherein a change in status of the tag being either open or closed is written directly into a memory of the embedded RFID.

4. The system according to claim 1 wherein said RFID Tag is attached or affixed to an item of merchandise and said tag is commissioned so that its operator ID is captured by the system; its date and time of commissioning is recorded for the merchandise item; and upon the tag being affixed its RF inlay is recorded; its first sequential event is recorded a validation is performed by the master database that the last unique event was decommissioning of the tag and if not, a signal is sent to the manager for investigation; the chip is then activated and the item is added to the inventory in the master database.

5. The system according to claim 4 wherein the master data base is interrogated and compares information from the tag for the new merchandise item with the master database and If the tag is determined to be an out of sequence event e.g. the number of openings and closings do not match then a signal is sent to the manager to investigate.

6. The system according to claim 5 wherein if no tag is found a signal is sent to the manager for investigation.

7. The system according to claim 1 wherein said recordation of said first sequential event is the commissioning or closing of the tag to said merchandise item.

8. The system according to claim 1 wherein said system is capable of periodic scanning to capture for the tagged merchandise item an operator ID, the date and time; a unique RFID inlay and a unique sequence event for this tag.

9. The system according to claim 1 wherein said system scans at a point of sale and in doing so captures the operator ID of the tag; the date and time; the unique RFID inlay number and the next sequential event and removes the tag from inventory; and marks the tag for recommissioning for use in a master database.

10. The system according to claim 9 wherein the tag is decommissioned and made ready for use for a next merchandise item received.

11. The system according to claim 1 wherein the tag includes a pin 6 which is inserted into an opening of said RF ID tag and is locked in place by a clutch mechanism to affix the tag to the item of merchandise.

12. The system according to claim 11 wherein the pin and clutch mechanism can be unlocked and relocked at point of sale.

13. The system according to claim 12 wherein the pin is inserted into the clutch at the time of RFID encoding of the RFID tag to completes a circuit for notifying the on board RF transmitter and circuit that the tag is locked and records the time and date of each lock/unlock event and a sequence of these events.

14. The system according to claim 13 wherein this recorded information is provided to the master database using the unique RFID encoded item number showing that the item is locked and in inventory, and including as the lock/unlock sequence number.

15. An inventory and/or anti-theft alarm tag method, the steps comprising: Affixing an RFID tag or label to an item of merchandise, said RFID tag adapted to communicate with a master database via an RF transmitter in said RF ID tag; providing said RFID tag with including a unique RFID inlay having a unique RFID encoded item number encoded therein; and communicating between said RFID tag and said master database via said RF transmitter wherein said master database compares said information from said RF tag with that stored in said master database to determine if said tag is authentic and has been open or closed the number of times indicated in the master data base, and if so a message is sent to a store manager to investigate.

* * * * *